US006043786A

United States Patent [19]

Vannatta et al.

[11] Patent Number: 6,043,786

[45] Date of Patent: Mar. 28, 2000

[54] MULTI-BAND SLOT ANTENNA STRUCTURE AND METHOD

[75] Inventors: Louis Jay Vannatta, Crystal Lake; Hugh Kennedy Smith, Palatine, both of Ill.

[73] Assignee: Motorola, Inc., Schaumburg, Ill.

[21] Appl. No.: 08/854,282

[22] Filed: May 9, 1997

[51] Int. Cl.[7] ..... H01Q 13/10

[52] U.S. Cl. ..... 343/770; 343/700 MS; 343/767

[58] Field of Search ..... 343/770, 767, 343/700 MS, 702

[56] References Cited

U.S. PATENT DOCUMENTS

| | | | |
|---|---|---|---|
| 4,410,890 | 10/1983 | Davis et al. | 343/767 |
| 4,864,314 | 9/1989 | Bond | 343/700 MS |
| 5,446,471 | 8/1995 | Chung et al. | 343/770 |
| 5,489,913 | 2/1996 | Raguenet et al. . | |
| 5,600,337 | 2/1997 | Cassel | 343/770 |
| 5,610,618 | 3/1997 | Adrian et al. | 343/767 |

FOREIGN PATENT DOCUMENTS

| | | |
|---|---|---|
| 1 285 289 | 8/1972 | United Kingdom . |
| 2 074 792 | 11/1981 | United Kingdom . |
| WO 96/29757 | 9/1996 | WIPO . |

OTHER PUBLICATIONS

"Microstrip Lines And Slotlines," by K.C. Gupta, Ramesh Garg, and I.J. Bahl, Artech, Chapter 6, Slotlines 11, pp. 231–254.

IEEE Transactions On Microwave Theory And Techniques, vol. MTT–17, No. 12, Dec. 1969, "Slot Line Characteristics," by Elio A. Mariani, Charles P. Heinzman, John P. Agrios, and Seymour B. Cohn, pp. 1091–1096.

IEEE Transitions On Microwave Theory And Techniques, May 1974, "Slot–Line Transactions," by Jeffrey B. Knorr, pp. 548–554.

IEEE Transactions On Microwave Theory And Techniques, Aug. 1976, Letters, "Expressions for Wavelength And Impedance Of A Slotline," by Ramesh Garg And K.C. Gupta, p. 532.

*Primary Examiner*—Don Wong
*Assistant Examiner*—Hoang Nguyen
*Attorney, Agent, or Firm*—Sylvia Chen

[57] ABSTRACT

The multi-band slot antenna structure and method uses a single antenna to cover at least two distinct reception frequency bands using only one excitation port. In a first type of configuration, dual resonant slots (320, 325) are placed in close proximity and driven using a single differential excitation port having a positive node (370) and a negative node (375). In a second type of configuration, a half wavelength conductor (560, 660, 760) is layered over a quarter wavelength slot (520, 720) or half wavelength slot (620), and when the conductor is heavily magnetically coupled to the slot, a virtual electric short is achieved across the slot. In a third type of configuration, a quarter wavelength conductor (1060, 1160) is layered over a quarter wavelength slot (1020) or half wavelength slot (1120), and the conductor is used to capacitively or inductively load the slot (1120) at frequencies other than the natural resonant frequency of the slot (1120).

16 Claims, 6 Drawing Sheets

— PRIOR ART —

110

— PRIOR ART —

210

510

610

1010

1110

MULTI-BAND SLOT ANTENNA STRUCTURE AND METHOD

CROSS REFERENCE TO RELATED APPLICATIONS

This application is related to application Ser. No. 08/854,197 entitled "Multi-Layered Compact Slot Antenna Structure and Method" by David R. Haub, Louis J. Vannatta, and Hugh K. Smith (Attorney Docket No. CE01551R) filed same date herewith, the specification of which is incorporated herein by reference. This application is also related to application Ser. No. 08/853,772 entitled "Difference Drive Diversity Antenna Structure and Method" by Louis J. Vannatta, Hugh K. Smith, James P. Phillips, and David R. Haub (Attorney Docket No. CE01547R) filed same date herewith, the specification of which is incorporated herein by reference.

FIELD OF THE INVENTION

This invention relates generally to slot antennas, and more particularly to multi-band slot antennas.

BACKGROUND OF THE INVENTION

Slot antennas can be implemented with a gap in a metal surface. Simple resonant slot antenna geometries include a half wavelength ($\lambda/2$) slot antenna 110 as shown in prior art FIG. 1 and a quarter wavelength ($\lambda/4$) slot antenna 210 as shown in prior art FIG. 2. For a $\lambda/2$ slot antenna 110, the length 140 of the slot 120 is a half wavelength and both ends of the slot 120 are closed, while for a $\lambda/4$ slot antenna 210, the length 240 of the slot 220 is a quarter wavelength and only one end of the slot 220 is closed while the other end is open. A conductive ground plane 130, 230 surrounds each slot 120, 220. The $\lambda/2$ slot antenna 110 is driven differentially from an excitation port having a positive node 170 and a negative node 175 located near the closed end of the slot 120 and perpendicular to the slot 120 as shown. The $\lambda/4$ slot antenna 210 is also driven differentially from an excitation port having a positive node 270 and a negative node 275 located near the closed end of the slot 220 and perpendicular to the slot 220 as shown.

Some radiotelephones require signal reception in more than one frequency band. More than one slot antenna can be used in a radiotelephone to obtain reception in the required bands, however, separate antennas require separate excitation ports and individual electronic tuning mechanisms, which can get expensive. Thus, there is a need for an antenna with a single excitation port and multi-band reception capability.

DETAILED DESCRIPTION OF THE PREFERRED EMBODIMENTS

The multi-band slot antenna covers two distinct reception frequency bands using only one excitation port. In a first type of configuration, dual resonant slots are placed in close proximity and driven using a single excitation port. The lengths and widths of the two slots, the separation distance between the slots, and the location of the excitation port affect the performance achieved by the multi-band slot antenna. In a second type of configuration, a quarter wavelength or half wavelength resonator is layered over a quarter wavelength or half wavelength slot, and when the resonator is heavily magnetically coupled to the slot, a virtual electric short is achieved across the slot. This gives rise to two resonant frequencies: one at the resonant frequency of the slot alone, and another at the resonant frequency of the slot coupled with the resonator. In a third type of configuration, a quarter wavelength resonator is layered over a quarter wavelength or half wavelength slot, and the resonator is used to capacitively or inductively load the slot at frequencies other than the natural resonant frequency of the slot 1020. This approach enlarges the bandwidth of the slot rather than creates a distinct second radiant frequency band.

Figure 1:
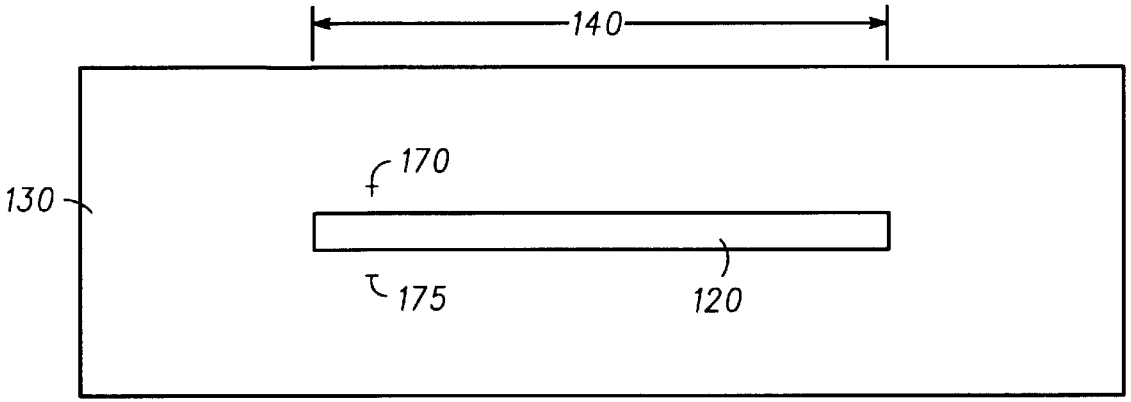
FIG. 1 shows a prior art half wavelength slot antenna.
Figure 2:
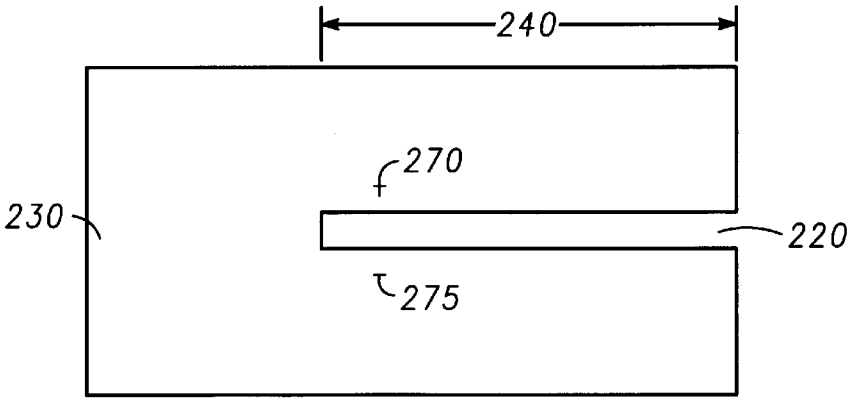
FIG. 2 shows a prior art quarter wavelength slot antenna.
Figure 3:
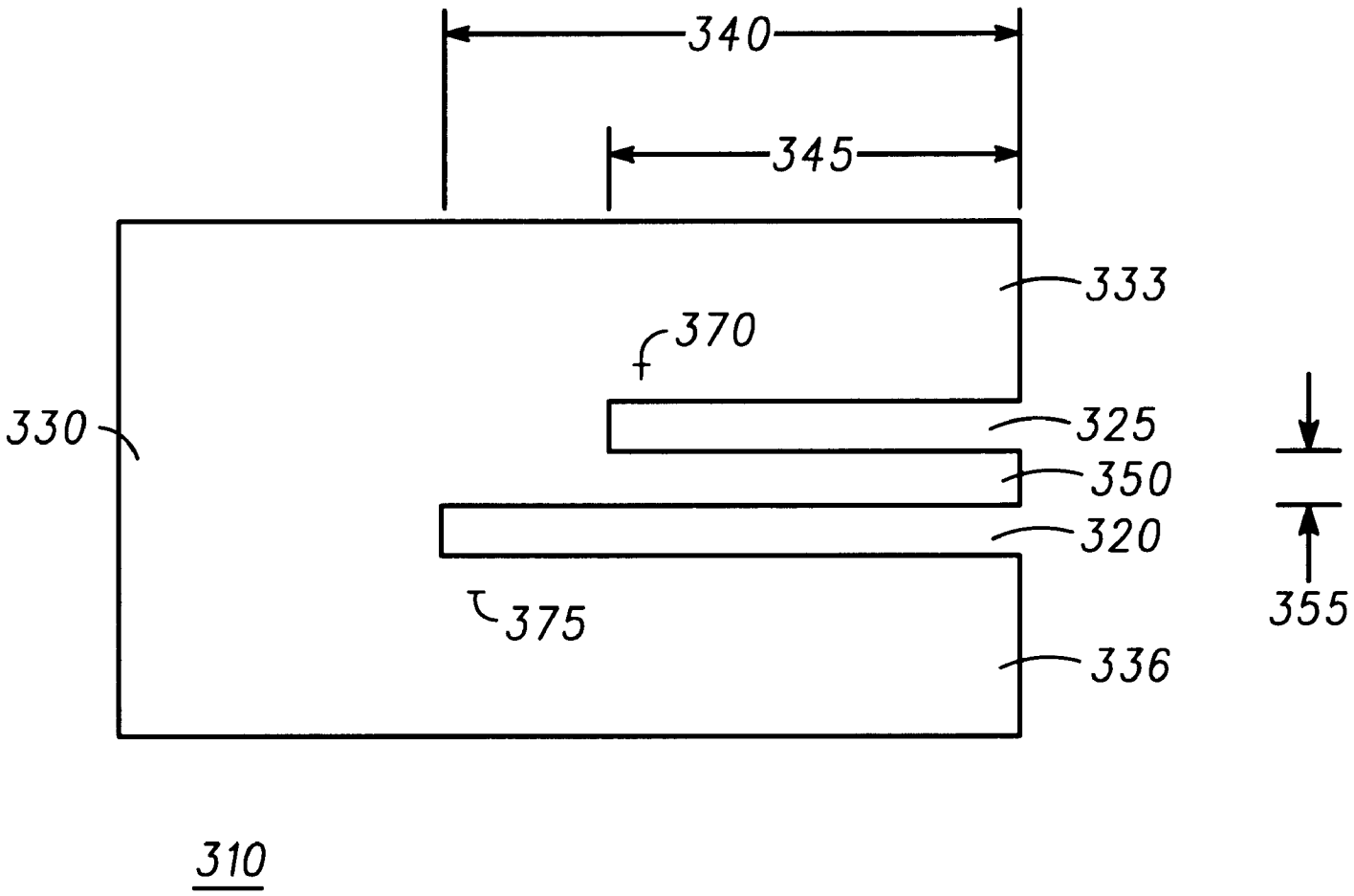
FIG. 3 shows a diagram of the multi-band slot antenna in a first type of configuration according to a first preferred embodiment.

FIG. 3 shows a diagram of the multi-band slot antenna 310 in a first type of configuration according to a first preferred embodiment. In the first type of configuration, dual resonant slots are placed in close proximity and driven using a single differential excitation port. The lengths and widths and locations of the two slots affect the radiation frequency bands achieved by the multi-band slot antenna.

A first slot 320 of length 340 and a second slot 325 of length 345 are implemented in a conductive ground plane 330. A narrow strip 350 of the ground plane 330 is common to the slots 320, 325. The close proximity between the two slots allows coupling of a single driven port across both slots as shown. The distance of each coupling point from a closed end of the nearest slot is proportional to the length of the slot and the proportion is determined by the source impedance. For example, for a 50 ohm source impedance, the positive node 370 of the differential excitation port is connected at a distance from a closed end of the shorter slot 325 that is approximately equal to one-tenth of the length 345 of the slot 325 while the negative node 375 of the differential excitation port is connected at a distance from the closed end of the longer slot 320 that is also approximately equal to one-tenth of the length 340 of that slot. If the source impedance changes, the proportional distance from the positive node and the negative node also changes.

When the signal from the driven port is at a first resonant frequency $f_1$, the currents travels mainly about the slot 325, and the antenna radiates in a first frequency band as determined primarily by the dimensions of the slot 325. On the other hand, when the signal from the driven port is at a second resonant frequency $f_2$, the currents travel mainly about the slot 320, and the antenna radiates in a second frequency band as determined primarily by the dimensions of slot 320.

Each slot may have a different width, and the width of each slot also may vary. Also, each slot may be either a quarter wavelength or a half wavelength configuration. Both slots 320, 325 shown in this drawing are quarter wavelength slots and have consistent widths of approximately 2 mm. Either one of the slots or both, however, could be replaced by half wavelength slots. The width 355 of the strip 350 common to the slots 320, 325 is also approximately 2 mm. Adjusting the lengths 340, 345 of the two slots changes the operational frequency bands of the multi-band antenna. In this embodiment, open ends of both slots 320, 325 are aligned parallel to the ends 333, 336 of the ground plane 330, while closed ends of both slots 320, 325 are staggered due to the different lengths of the slots.

Figure 4:
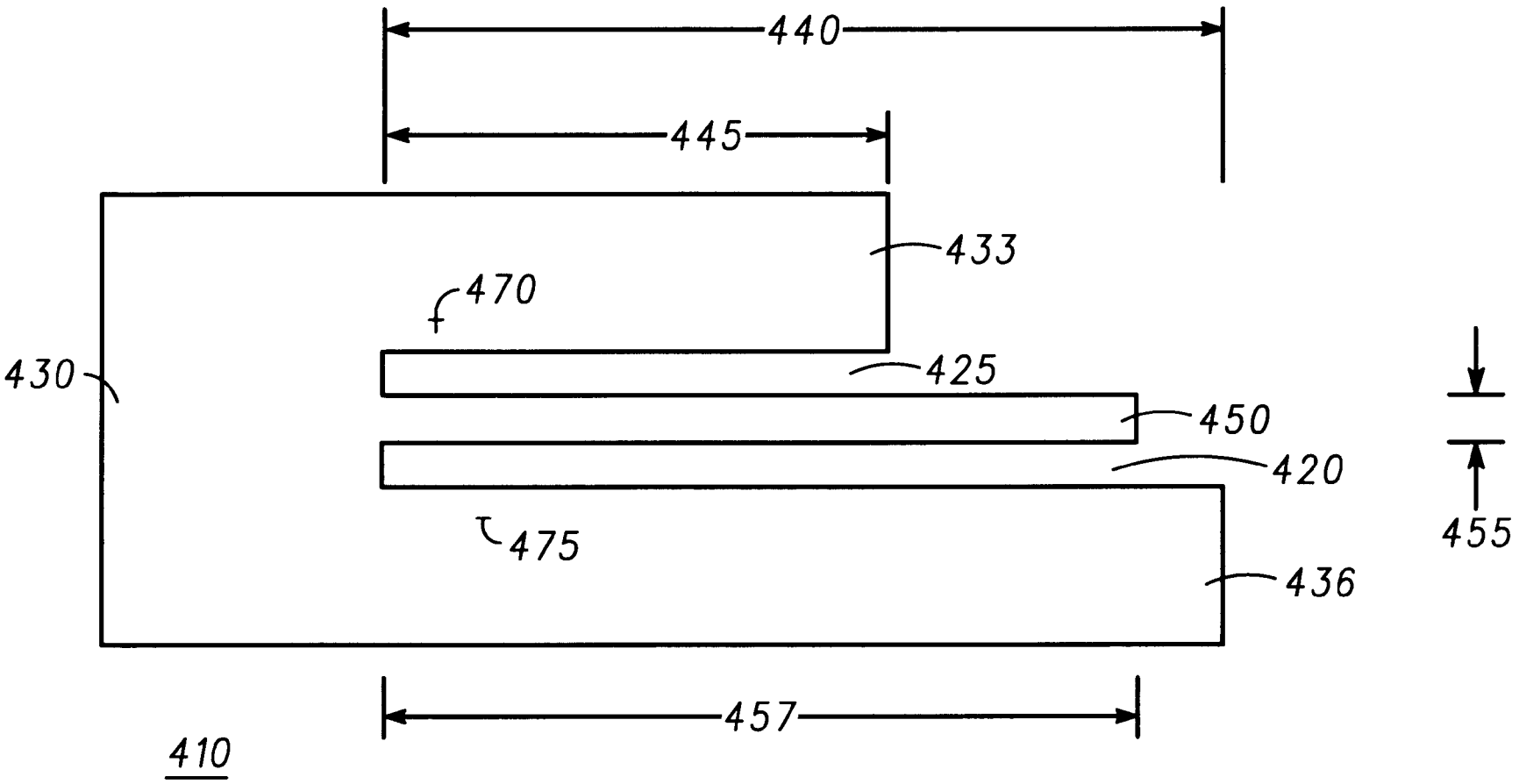
FIG. 4 shows a diagram of the multi-band slot antenna in the first type of configuration according to a second preferred embodiment.

FIG. 4 shows a diagram of the multi-band slot antenna 410 in the first type of configuration according to a second preferred embodiment. In this embodiment, closed ends of the slots 420, 425 are aligned parallel to one edge of the ground plane 430. Open ends of the slots 420, 425 are staggered due to the different lengths 440, 445 of the slots. The electrical length of the first slot 420 is determined primarily by the shorter of either the length 457 of the strip 450 common to the slots 420, 425 or the distance from the closed end of the slot 420 to the end 436 of the ground plane 430. The electrical length of the second slot 425 is similarly primarily determined by either the shorter of the length 457 of the strip 450 or the distance from the closed end of the slot 425 to the end 433 of the ground plane. End effects, caused by the longer of the two dimensions, may cause the electrical length of each slot 420, 425 to vary slightly from the physical length 440, 445 of the slot.

In the example shown, the length 440 of the slot 420 is approximately equal to the length 457 of the strip 450. Thus, the distance from the closed end of the slot 420 to the end 436 can be reduced to the length 457 of the strip 450 or extended indefinitely without any significant effect on the operation of the multi-band slot antenna 410. Both slots 420, 425 are driven differentially as shown by a single excitation port, yet the two slots radiate at different frequency bands.

As in the embodiment shown in FIG. 3, the distance of each coupling point from a closed end of the nearest slot is proportional to the length of the slot and dependent on the source impedance. For example, for a 50 ohm source impedance, the positive node 470 of the differential excitation port is connected at a distance from a closed end of the shorter slot 425 that is approximately equal to one-tenth of the length 445 of the slot 425 while the negative node 475 of the differential excitation port is connected at a distance from the closed end of the longer slot 420 that is also approximately equal to one-tenth of the length 457 of that slot. If the source impedance changes, the proportional distance from the positive node and the negative node also changes.

Each slot may have a different width, and the width of each slot also may vary. Also, each slot may be either a quarter wavelength or a half wavelength configuration. If the lengths, widths, and configurations of the slots 420, 425 and the width 455 of the strip 450 are identical to the lengths, widths, and configurations of the slots 320, 325 and the width 355 of the strip 350 shown in FIG. 3, then the embodiment shown in FIG. 3 and the embodiment shown in FIG. 4 operate in very similar frequency bands. In most cases, however, the frequency bands will not be exactly the same due to differing end effects.

Figure 5:
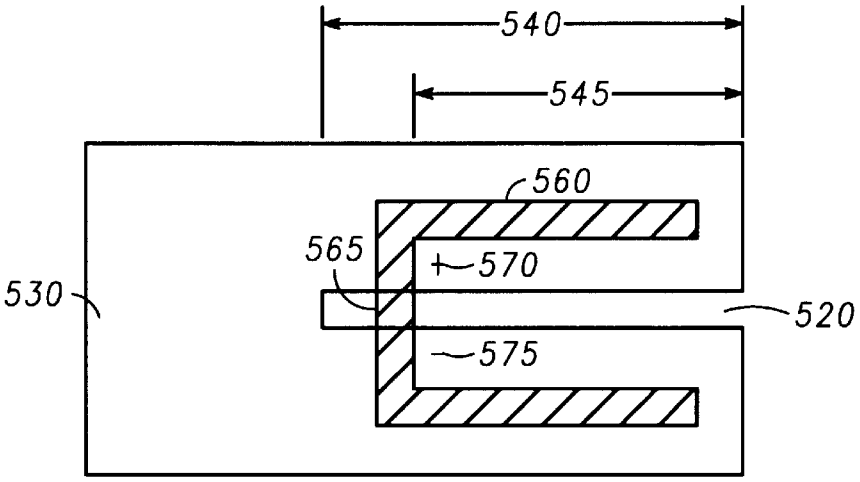
FIG. 5 shows a diagram of a multi-band slot antenna in a second type of configuration according to a first preferred embodiment.

FIG. 5 shows a diagram of a multi-band slot antenna 510 in a second type of configuration according to a first preferred embodiment. In the second type of configuration, a half wavelength resonator in a dielectric material is layered over a quarter wavelength or half wavelength slot in a metal surface. At a certain resonant frequency $f_2$, the resonator is magnetically coupled to the slot and a virtual electric short is achieved across the slot. At frequencies other than the first resonant frequency, the resonator is negligibly magnetically coupled to the slot (i.e., out of circuit). This gives rise to two resonant frequencies: one at the resonant frequency $f_1$ of the slot alone, and another higher resonant frequency $f_2$ caused by the slot coupled with the resonator.

In this first embodiment of the second type of configuration, a slot 520 is included on a ground plane 530. The length 540 of this slot is a quarter wavelength at a first frequency $f_1$ as measured or determined in the ground plane 530. On a second layer, which is hatched for clarity, a conductor 560, such as a microstrip line, in a dielectric substrate is laid in a U-shaped configuration. The microstrip line conductor 560 can have other configurations, such as a straight line or a curve, however the U-shape is preferred to reduce the needed surface area for the antenna 510.

The length of the entire conductor 560, from one end to the other, is a half wavelength at a second frequency $f_2$ as measured or determined in the dielectric substrate. Note that as the dielectric constant of the dielectric substrate of the microstrip line conductor 560 increases, the physical length of the conductor 560 decreases. The midpoint 565 of the microstrip line conductor 560 crosses the slot 520 at a length 545 from the open end of the slot 520. The length 545 is equal to a quarter wavelength at the second frequency $f_2$ as measured or determined in the conductive ground plane 530.

At the first frequency $f_1$, the slot 520 is resonant, which creates a radiator at a first frequency range. The midpoint 565 of the microstrip line conductor 560 has relatively high impedance at first frequency $f_1$ with respect to the ground plane 530, so the conductor 560 is negligibly coupled to the slot 520 and does not significantly affect the operation of the slot 520 at the first frequency band. At the second frequency $f_2$, however, the midpoint 565 of the conductor 560 has a very low impedance with respect to the ground plane 530. The low impedance across the slot 520 where the conductor 560 crosses the slot 520 causes a virtual short circuit across the slot at the length 545 from the open end of the slot 520. This essentially shortens the electrical length of the slot 520 to the length 545. Because the slot 520 is now effectively shortened, the antenna 510 is now radiant in a second, higher frequency band. The multi-band slot antenna 510 is driven differentially from a positive node 570 and a negative node 575 proximate to the slot 520 and positioned at a compromise position relative to lengths 545, 540. Because the distance from the differential port to the closed end of the slot is different when the slot is effectively shortened and when it is not effectively shortened, the differential port position cannot be optimized for both cases simultaneously.

Multiple conductors having a length equal to a half wavelength at other desired resonant frequencies, as measured or determined in a dielectric that surrounds the conductor, can be layered across the top of the slot 520 to create an antenna that is radiant in more than two frequency bands. The midpoint of the additional conductors should cross the slot at a distance approximately equal to a quarter wavelength at the desired resonant frequency, as measured or determined in the ground plane 530. Multiple conductor configurations must also take into account the interactions between the individual conductors.

Figure 6:
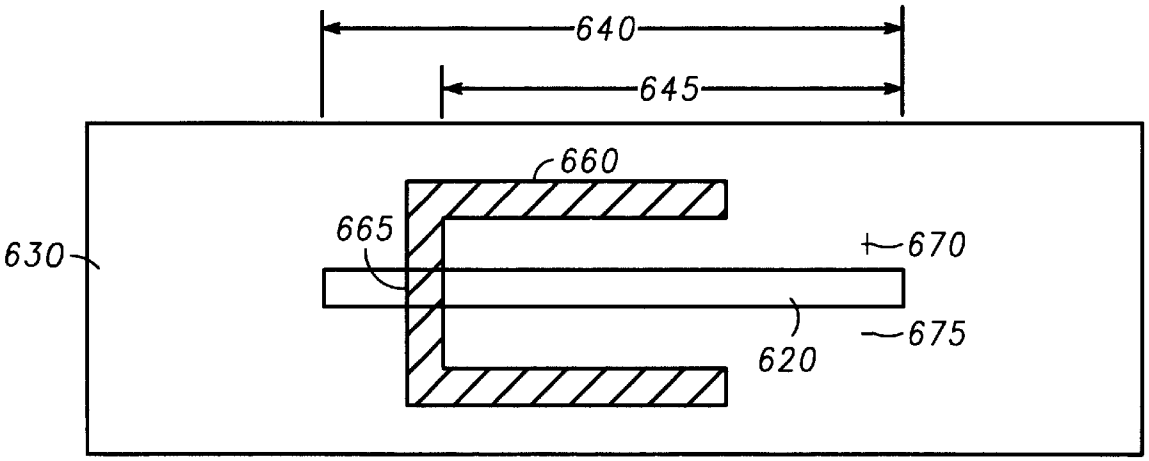
FIG. 6 shows a diagram of a multi-band slot antenna in the second type of configuration according to a second preferred embodiment.

This approach can also be used to create a multi-band half wavelength slot antenna. FIG. 6 shows a diagram of a multi-band slot antenna 610 in the second type of configuration according to a second preferred embodiment. In this embodiment, the slot 620 is a half wavelength at a first frequency f, as measured or determined in the ground plane 630. On a second layer, which is hatched for clarity, a conductor 660, such as a microstrip line, in a dielectric substrate is configured in a U-shape and placed across the slot 620 so that the midpoint 665 of the microstrip line conductor 660 crosses the slot 620 at a length 645 from one end of the slot. The microstrip line conductor 660 can have other configurations, such as a straight line or a curve, however the U-shape is preferred to reduce the needed surface area for the antenna 610.

The length of the entire conductor 660, from one end to the other, is a half wavelength at a second frequency $f_2$ as measured or determined in the dielectric substrate. Note that as the dielectric constant of the dielectric substrate of the conductor 660 increases, the physical length of the conductor 660 decreases. The length 645 represents a half wavelength of the second frequency $f_2$ as measured or determined in the conductive ground plane 630.

When a signal at the first frequency $f_1$ reaches the slot, the length 640 of the slot 620 resonates to radiate in a first frequency band. Because the conductor 660 is not resonant at the first frequency, the midpoint 665 of the microstrip line conductor 660 has a high impedance relative to the ground plane 630 such that the operation of the slot 620 at the first frequency $f_1$ is not significantly affected by the conductor 660. When the conductor 660 is resonant at the second frequency $f_2$, however, the impedance relative to the ground plane 630 at midpoint 665 is very low, and there is a virtual short across the slot 620 at the length 645 from one end of the slot. This shortens the operable section of the slot 620 to a length 645 that is radiant at the second, higher frequency $f_2$.

The multi-band slot antenna 610 is driven differentially from a positive node 670 and a negative node 675 proximate to the slot 620 and positioned near a closed end of the slot 620. Preferably, the positive node 670 and the negative node 675 are placed at a closed end that is unencumbered by the conductor 660 so that the distance from the differential port to the closed end of the slot remains consistent for both frequency bands of operation. Alternately, the positive node 670 and the negative node 675 can be positioned analogous to the differential port shown in FIG. 5.

Adding additional conductors across the slot 620 causes the antenna to be radiant at more frequency bands, however, multiple conductor configurations must take into account the interactions between the individual conductors. Each additional conductor generally has a length equal to a half wavelength at the desired resonant frequency, as measured or determined in a dielectric that surrounds the conductor, and the midpoint of the additional conductor crosses the slot a length approximately equal to a quarter wavelength at the desired resonant frequency, as measured or determined in the ground plane 630.

Figure 7:
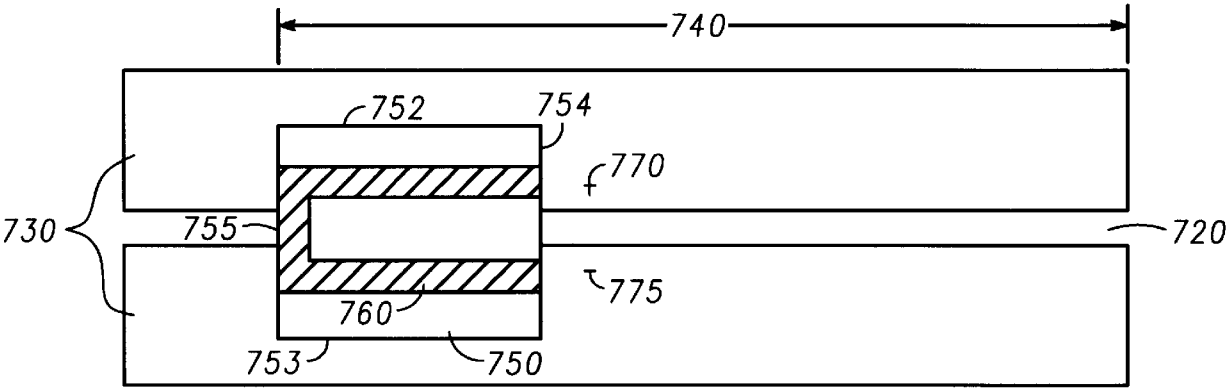
FIG. 7 shows a top-view diagram of a multi-band antenna in the second type of configuration according to a third preferred embodiment.

The microstrip line conductors 560, 660 imbedded in a dielectric material as shown in FIGS. 5 and 6 can be replaced with a resonator block 750 to achieve the same results of adjusting the electrical length of a slot antenna at a second frequency to create a slot antenna that is radiant in two frequency bands. FIG. 7 shows a top-view diagram of a multi-band antenna 710 in the second type of configuration according to a third preferred embodiment. A ground plane 730 is preferably completely divided into two physical halves by a slot 720 and driven differentially as shown. The ground plane 730, however, can be in the shape of a conventional quarter wavelength slot. A differential excitation port has a positive node 770 and a negative node 775 positioned perpendicular to the slot 720 of the multi-band antenna 710.

A resonator block 750 has a conductive sheath partially covering the surface of the resonator block and contacts both halves of the ground plane 730 of the multi-band slot antenna 710. Thus, the conductive sheath of the resonator block effectively becomes part of the ground plane 730 and the configuration of the conductive sheath produces a closed end to the slot 720. The resonator block 750 is made of a material having a high dielectric constant and has a conductor 760 embedded in the block. The conductor 760 shown is a double-rod structure, however, other shapes such as a horseshoe or a straight rod may be substituted. The length of the conductor 760, from one end to the other, is a half wavelength at a second frequency $f_2$ as measured or determined in the dielectric of the resonator block 750. Additional details of the resonator block 750 will be explained with reference to FIGS. 8 and 9.

Figure 8:
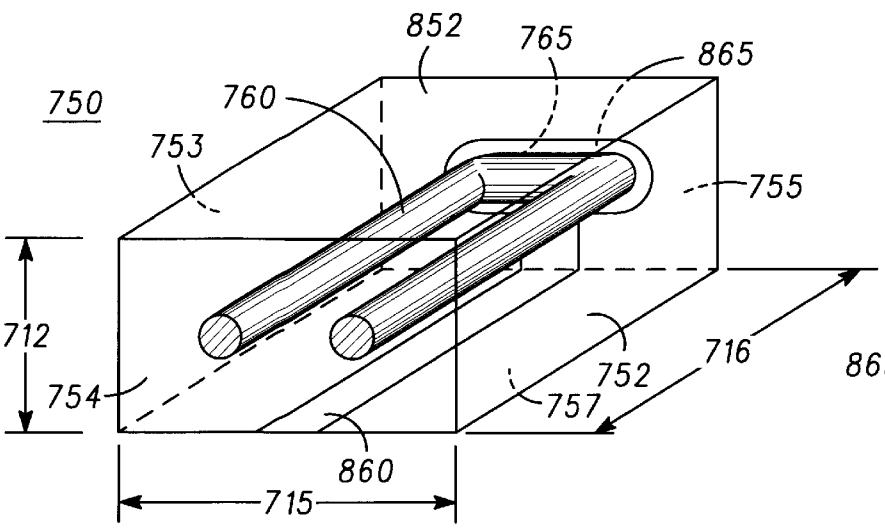
FIG. 8 shows a front perspective view of the resonator block.
Figure 9:
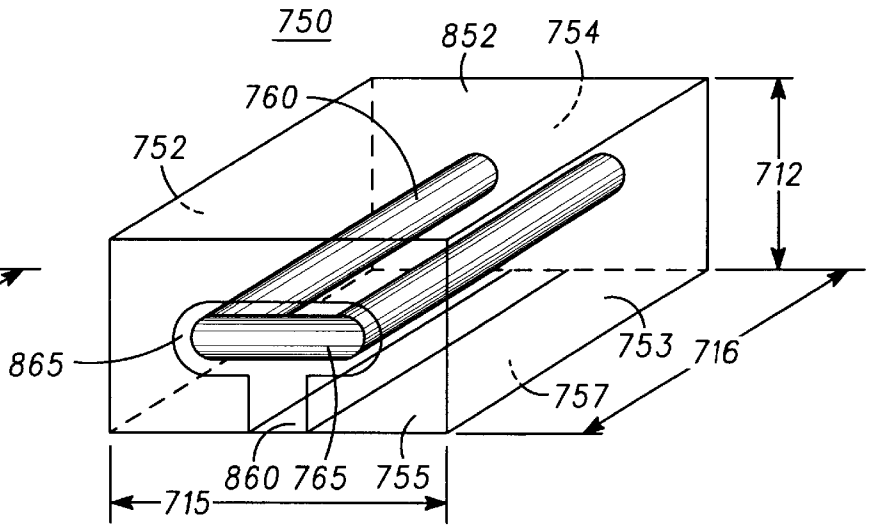
FIG. 9 shows a back perspective view of the resonator block.

FIGS. 8 and 9 show front and back perspective views of the resonator block 750. The resonator block has a height 712, width 715, and length 716. The conductor 760 is embedded in the resonator block 750 and the back 765 of the double-rod structure is flush with the back surface 755 of the resonator block 750. The conductive sheath 852 completely covers the side surfaces 752, 753 of the resonator block 750 that are parallel to the slot 720. The front surface 754 of the resonator block 750 is preferably not conductive. The bottom surface 757 of the resonator is mostly conductive except for the section 860 of the resonator block 750 that lies above the slot 720. The section 860 where the resonator block 750 is not conductive travels up the back surface 755 of the block and expands into an extension 865 having a shape, for example an oval or rectangle, that isolates the back 765 of the conductor 760 from the remainder of the resonator block 750 that is covered by the conductive sheath 852. The back 765 of the conductor 760 can have shapes other than the oval shown, such as a rectangular or even irregular shape, and the extension 865 can also have other shapes as long as the extension 865 isolates the back 765 of the conductor 760 from the conductive sheath 852 such that the conductive sheath 852 is never directly connected to the conductor 760. In fact, the entire back surface 755 of the resonator block 750 can exclude the conductive sheath.

The outer circumference of the extension 865 of the resonator block 750 affects the first resonant frequency $f_1$ of the slot 720 when the conductor 760 is not magnetically coupled to the slot 720. Essentially, the conductive sheath of the resonator block 750 is coupled to the ground plane 730 of the antenna 710, and the nonconductive section 860 and extension 865 determine the electrical length of the slot 720.

When a half wavelength at the second frequency $f_2$ is equal to the length of the conductor 760, the conductor 760 magnetically couples to the slot 720. The magnetically coupled half wavelength conductor 760 provides an electrical short through the back 765 of the conductor 760. When this electrical short occurs at a distance that represents a quarter wavelength at the second frequency, as determined in the conductive ground plane 730, the resonator block 750 decreases the electrical length of the slot 720 and creates a second radiant frequency band.

This approach is exactly the same as the microstrip line conductor approach shown in FIGS. 5 and 6. Due to the dimensions of the resonator block 750 and its dielectric constant, however, the second radiant frequency band can be either higher or lower than the first radiant frequency band.

This resonator block approach can also be implemented with a half wavelength slot antenna analogous to the antenna shown in FIG. 6. Instead of positioning the resonator block on an open-ended slot as shown in FIG. 7, the resonator block should be positioned on a slot that has one end closed. The conductive sheath surrounding the resonator block 750 then provides the second closed end of the antenna.

Figure 10:
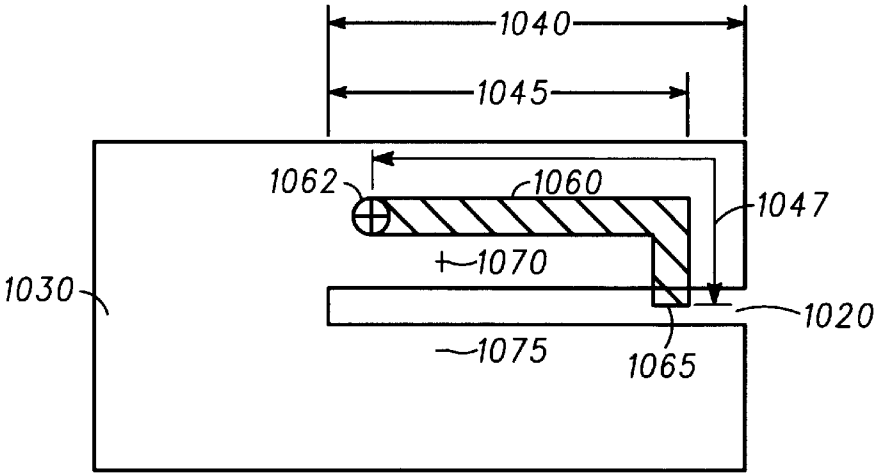
FIG. 10 shows a diagram of a multi-band slot antenna in a third type of configuration according to a first preferred embodiment.

FIG. 10 shows a diagram of a multi-band slot antenna 1010 in a third type of configuration according to a first preferred embodiment. In this third type of configuration, a quarter wavelength resonator is layered over a quarter wavelength or half wavelength slot, and the resonator is used to capacitively or inductively load the slot at frequencies other than the natural resonant frequency of the slot 1020. This approach enlarges the bandwidth of the slot rather than creates a distinct second radiant frequency band.

A quarter wavelength slot 1020 of length 1040 is implemented on a conductive ground plane 1030 of a first layer. This slot 1020 is a quarter wavelength at a first frequency $f_1$ as measured or determined in the conductive ground plane 1030. The slot 1020 is driven differentially by an excitation port having a positive node 1070 and a negative node 1075 positioned proximate to the slot 1020 as shown.

On a second layer, which is hatched for clarity, a conductor 1060, such as a microstrip line, in a dielectric substrate is laid in a L-shaped configuration with one end 1065 of the microstrip line conductor 1060 entering, but not crossing, the slot 1020. The microstrip line conductor 1060 can have other configurations, such as a straight line or a curve, however, the L-shape is preferred to reduce the needed surface area for the antenna 1010. The length 1047 of the entire conductor 1060, from one end to the other, is a quarter wavelength at a second frequency $f_2$ as measured or determined in the dielectric substrate. The second frequency $f_2$ is selected to be similar to the first frequency $f_1$. One end of the slot is a via 1062 to the conductive ground plane 1030 of the first layer. This via shorts the conductor 1060 to the ground plane 1030. The other end 1065 of the conductor 1060 stops over the slot 1020 in the first layer. The end 1065 of the conductor 1060 enters the slot 1020 at a length 1045 from the closed end of the slot 1020. This length 1045 is approximately equal to a quarter wavelength of the second resonant frequency $f_2$ of the conductor 1060 as determined in the conductive ground plane 1030.

At the first frequency $f_1$, the entire length 1040 of slot 1020 is resonant, which creates a radiator at a first frequency range. The second resonant frequency $f_2$ is selected so that the end 1065 of the conductor 1060 does not significantly affect the operation of the slot at the first frequency band. At frequencies other than the first frequency $f_1$, the conductor 1060 begins to capacitively or inductively load the slot at end 1065. If the frequency is slightly larger than the second resonant frequency $f_2$, the end 1065 exhibits capacitance, and the resonant frequency of the slot 1020 decreases. If the frequency is slightly smaller than the second resonant frequency $f_2$, the end 1065 exhibits inductance, and the resonant frequency of the slot 1020 increases. Thus, the resonant bandwidth of the slot 1020 increases.

Figure 11:
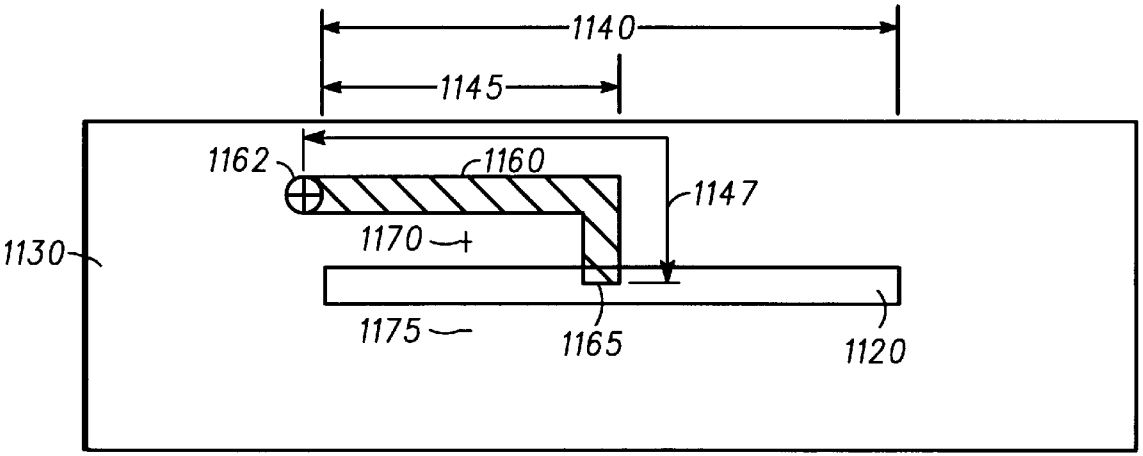
FIG. 11 shows a diagram of a multi-band slot antenna in the third type of configuration according to a second preferred embodiment.

FIG. 11 shows a diagram of a multi-band slot antenna 1110 in the third type of configuration according to a second preferred embodiment. In this embodiment, a quarter wavelength resonator is layered over a half wavelength slot 1020 to capacitively or inductively load the slot at frequencies other than the natural resonant frequency of the slot, which enlarges the bandwidth of the slot.

The slot 1120 on a first layer in a ground plane 1130 is a half wavelength at a first resonant frequency $f_1$ as measured or determined in the conductive ground plane 1130. The slot 1120 is driven differentially by an excitation port having a positive node 1170 and a negative node 1175 positioned proximate to the slot 1120 as shown.

A conductor 1160, such as a microstrip line, in a dielectric substrate is configured on a second layer, hatched for clarity, in an L-shape and placed across the slot 1120 so that the end 1165 of the microstrip line conductor 1160 crosses the slot 1120 at a length 1145 from one end of the slot. The microstrip line conductor 1160 can have other configurations, such as a straight line or a curve, however, the L-shape is preferred to reduce the needed surface area for the antenna 1110. The end 1165 of the conductor 1160 enters the slot 1120 at a length 1145 from the closed end of the slot 1120. This length 1145 is approximately equal to a quarter wavelength of the second frequency $f_2$ as determined in the conductive ground plane 1130. The other end of the microstrip line conductor 1160 contains a via 1162 to the ground plane 1130 in the first layer. The length 1147 of the conductor 1160 is a quarter wavelength at the second frequency $f_2$ as measured or determined in the dielectric. The second frequency $f_2$ is selected to be similar to the first frequency $f_1$.

When a signal at the first frequency $f_1$ reaches the slot, the entire length 1140 of the slot 1120 resonates to create radiation at a first frequency band. The second resonant frequency $f_2$ is selected so that the end 1165 of the conductor 1160 does not significantly affect the operation of the slot at the first frequency band. At frequencies other than the first frequency $f_1$, the conductor 1160 begins to capacitively or inductively load the slot at end 1165. If the frequency is slightly larger than the second resonant frequency $f_2$, the end 1165 exhibits capacitance, and the resonant frequency of the slot 1120 decreases. If the frequency is slightly smaller than the second resonant frequency $f_2$, the end 1165 exhibits inductance, and the resonant frequency of the slot 1120 increases. Thus, the resonant bandwidth of the slot 1120 increases.

Thus, the multi-band slot antenna provides a multi-band antenna with only one differential driven point. While specific components and functions of the multi-band slot antenna are described above, fewer or additional functions could be employed by one skilled in the art within the true spirit and scope of the present invention. The invention should be limited only by the appended claims.

We claim:

1. A multi-band slot antenna resonant at both a first frequency and at a second frequency comprising:

a first slot, that is a quarter wavelength at the first frequency, having an open end and a closed end, implemented in a conductive ground plane;

a second slot, that is a quarter wavelength at the second frequency, having an open end and a closed end, implemented in the conductive ground plane;

a strip of the conductive ground plane common to the first slot and the second slot;

a positive node of a differential excitation port coupled to the conductive ground plane proximate to the first slot at a proportional distance from the closed end of the first slot; and a negative node of the differential excitation port coupled to the conductive ground plane proximate to the second slot at the proportional distance from the closed end of the second slot.

2. A multi-band slot antenna according to claim 1, wherein the open end of the first slot and the open end of the second slot are aligned.

3. A multi-band slot antenna according to claim 1, wherein the closed end of the first slot and the closed end of the second slot are aligned.

4. A multi-band slot antenna resonant and radiant at both a first frequency and at a second frequency comprising:

a slot implemented in a conductive ground plane that is resonant and radiant at the first frequency; and a conductor that is resonant but not appreciably radiant at the second frequency, different than the first frequency, and highly electromagnetically coupled to the first slot at the second frequency while negligibly electromagnetically coupled to the first slot at frequencies other than the second frequency, such that the slot is resonant and radiant at the second frequency.

5. A multi-band slot antenna according to claim 4, wherein the conductor is embedded in a dielectric material.

6. A multi-band slot antenna according to claim 5, wherein the conductor is a half wavelength at the second frequency as measured in the dielectric material.

7. A multi-band slot antenna according to claim 6, wherein the conductor is a microstrip line.

8. A multi-band slot antenna according to claim 7, wherein a midpoint of the microstrip line crosses the first slot antenna at a distance from an end of the first slot antenna approximately equal to a quarter wavelength at the second frequency as determined in the conductive ground plane.

9. A multi-band slot antenna according to claim 6, wherein the dielectric material is partially surrounded by a conductive sheath.

10. A multi-band slot antenna according to claim 9, wherein the conductive sheath couples to the conductive ground plane.

11. A multi-band slot antenna according to claim 5, wherein the conductor is a quarter wavelength at the second frequency as measured in the dielectric material.

12. A multi-band slot antenna according to claim 11, wherein the conductor is a microstrip line.

13. A multi-band slot antenna according to claim 12, wherein an end of the microstrip line is directly coupled to the conductive ground plane and another end of the microstrip line extends into the first slot antenna.

14. A radiotelephone comprising:

a first slot, that is a quarter wavelength at a first frequency, having an open end and a closed end, implemented in a conductive ground plane;

a second slot, that is a quarter wavelength at a second frequency, having an open end and a closed end, implemented in the conductive ground plane;

a strip of the conductive ground plane common to the first slot and the second slot;

a positive node of a differential excitation port coupled to the conductive ground plane proximate to the first slot at a proportional distance from the closed end of the first slot; and a negative node of the differential excitation port coupled to the conductive ground plane proximate to the second slot at the proportional distance from the closed end of the second slot.

15. A radiotelephone comprising:

a slot implemented in a conductive ground plane that is resonant and radiant at a first frequency; and a conductor that is resonant but not appreciably radiant at a second frequency, different than the first frequency, and highly electromagnetically coupled to the first slot at the second frequency while negligibly electromagnetically coupled to the first slot at frequencies other than the second frequency, such that the slot is resonant and radiant at the second frequency.

16. A radiotelephone according to claim 15 wherein the conductor is a microstrip line that is a half wavelength at the second frequency, and a midpoint of the microstrip line crosses the slot at a distance from an end of the slot approximately equal to a quarter wavelength at the second frequency.

* * * * *